US006234476B1

(12) United States Patent
Yamashita et al.

(10) Patent No.: US 6,234,476 B1
(45) Date of Patent: May 22, 2001

(54) AIR HOCKEY GAME APPARATUS

(75) Inventors: Akihisa Yamashita; Kojiro Minami; Eita Kada; Hideki Kotani; Yusuke Fujimoto; Hajime Dohki, all of Kobe (JP)

(73) Assignee: Konami Co., Ltd., Hyogo-ken (JP)

( * ) Notice: Subject to any disclaimer, the term of this patent is extended or adjusted under 35 U.S.C. 154(b) by 0 days.

(21) Appl. No.: 09/488,117

(22) Filed: Jan. 20, 2000

(30) Foreign Application Priority Data

Jan. 21, 1999 (JP) ..... 11-013649

(51) Int. Cl.[7] ..... A63F 7/00
(52) U.S. Cl. ..... 273/126 A
(58) Field of Search ..... 273/108, 108.1, 273/118 R, 118 A, 119 R, 119 A, 121 R, 121 A, 126 R, 126 A, 138.1, 138.2, 139

(56) References Cited

U.S. PATENT DOCUMENTS 3,931,974 * 1/1976 Goldfarb et al. ..... 273/126 R
4,323,241 * 4/1982 Deutsch ..... 273/121 A
4,991,845 * 2/1991 Wies ..... 273/121 A
5,104,607 * 4/1992 Driska ..... 273/126 A X
5,316,303 * 5/1994 Trudeau et al. ..... 273/121 A
5,931,465 * 8/1999 Miyake et al. ..... 273/126 A X
6,105,960 * 8/2000 Carames ..... 273/126 A X

* cited by examiner

*Primary Examiner*—Raleigh W. Chiu
(74) *Attorney, Agent, or Firm*—Jordon and Hamburg LLP

(57) ABSTRACT

An air hockey game apparatus allows game players to appropriately recognize statuses such as a game progress status, thereby effectively improving amusement characteristics. The air hockey game apparatus has a puck sliding surface having blowholes for blowing air to float a puck, an air-blower for blowing and sending air toward blowholes, a puck-reflecting frame around the puck sliding surface, and goals on the puck sliding surface. In the air hockey game apparatus, at least one portion of the puck sliding surface is transparent, and display sections are provided under the transparent portion, of which the display mode is changeable. Also, display-mode-setting units for setting the display mode of the display sections are provided, thereby controlling the display sections so as to be in the set display mode.

23 Claims, 16 Drawing Sheets

AIR HOCKEY GAME APPARATUS

BACKGROUND OF THE INVENTION

1. Field of the Invention

The present invention relates to an air hockey game apparatus with which game players compete with each other in hitting a puck into a goal. Particularly, the invention relates to an air hockey game apparatus that has a puck sliding surface having blowholes for blowing air to float the puck, an air-blower for blowing and sending the air toward the blowholes, a puck-reflecting frame provided on the puck sliding surface, and goals provided on the puck sliding surface.

2. Description of the Related Art

Hitherto, hockey game apparatuses have been suggested and are being sold. For example, Japanese Unexamined Patent Publication No. 8-299584 discloses an air hockey game apparatus that allows game players to hit a puck into a goal at the end of the opponent on a field having a large number of air-blowholes. The apparatus includes installation portions, electrical display units, and an audio output device. The installation portions are individually provided at two lateral portions in the middle of two sides of the field. The electrical display units display scores, and are provided above the field in a central portion of cylindrical support members extending from the installation portions at the two lateral portions. The audio output device produces sounds corresponding to the contents of the game.

However, problems arise in the described configuration. The electrical display units for displaying scores, which are provided above the central portion of the field made of a puck sliding surface, are effective to allow spectators to recognize the game progress status. To the game players however, the display units provide adverse effects.

The display units are ineffective to allow the game players to appropriately recognize the game progress status. The game players keep their eyes on the movement of the puck on the puck sliding surface, and their eyes must turn away from the movement of the puck to look up the electrical display units provided above the puck sliding surface. In other words, displays on the electrical display units hinder the progress of the game by the game players.

SUMMARY OF THE INVENTION

Under these circumstances, an object of the present invention is to provide an air hockey game apparatus that allows game players to appropriately recognize a game progress status, thereby effectively improving amusement characteristics of the game.

An air hockey game apparatus of the present invention has a puck sliding surface having blowholes for blowing air to float a puck and at least one transparent portion; an air-blower for blowing and sending air toward the blowholes; a puck-reflecting frame around the puck sliding surface; goals on the puck sliding surface; and display sections provided under the transparent portion, of which the display mode is changeable. Also, the air hockey game apparatus has a display-mode-setting unit for setting the display mode of the display sections, thereby controlling the display sections so as to be in the set display mode.

According to the described arrangement, the display sections under the transparent portion of the puck sliding surface display the display mode set by the display-mode-setting unit and change the display mode as required, thereby allowing game players to appropriately recognize predetermined information.

In the above arrangement, the air hockey game apparatus may further include display-mounting plates under the transparent portion so as to oppose positions where game players stand, wherein the display sections are provided on the display-mounting plates. This allows the game players to effectively view the display sections provided on the installation boards, thereby allowing the game players to appropriately recognize the predetermined information.

Also, an arrangement may be such that the described air hockey game apparatus further includes spaces partitioned by partitions individually having the display-mounting plates, and guide openings on the partitions for guiding the air transferred from the air-blower. According to this arrangement, the air from the air-blower to the aforementioned spaces is guided into guide openings provided on the partitions, and the air is transferred to blow onto the puck sliding surface from the blowholes.

Also, the air hockey game apparatus may further include a puck detector in at least one portion of the puck-reflecting frame, wherein the display-mode-setting unit sets the display modes of the display sections. According to this arrangement, the display modes of the display sections change corresponding to movement of the puck detected by the puck detector provided in at least one portion of the puck-reflecting frame. This provides dynamic characteristics to the game.

Also, the described air hockey game apparatus may further include goal-detecting units for detecting entry of the puck into the goals, wherein the display-mode-setting unit sets the display modes according to detection signals outputted by the goal-detecting units. According to this arrangement, corresponding to detection by the goal-detecting units for entry of the puck into the goals, the display modes of the display sections change. Therefore, the game players can effectively recognize their goal acquirement.

Also, the described air hockey game apparatus may be arranged such that the display sections display scores. This arrangement allows the game players to appropriately recognize the scores displayed in the display sections, thereby allowing an effective improvement in amusement characteristics of the game.

Also, in the describe air hockey game apparatus, the puck detector for detecting movement of the puck may be provided so as to oppose the puck sliding surface, and the display-mode-setting unit may be arranged to set the display modes of the display sections when the puck detector detects movement of the puck. According to this arrangement, the display modes of the display sections change corresponding to movement of the puck detected by the puck detector provided so as to oppose the puck sliding surface. This allows dynamic characteristics to be provided to the game.

Also, the described air hockey game apparatus may be arranged such that the puck detector for detecting passage of the puck is provided so as to oppose one portion of the puck sliding surface, in which the display-mode-setting unit sets the display modes when the puck detector detects passage of the puck. According to this arrangement, when the puck is hit toward the installation portions of the puck detector, the display modes of the display sections change, thereby allowing dynamic characteristics to be provided to the game.

Also, the described air hockey game apparatus may be arranged such that the puck detector is individually made of a plurality of light-sensitive detectors provided under the puck sliding surface, the puck detectors detect the direction in which the puck passes, and the display modes are changed corresponding to the direction in which the puck passes. According to this arrangement, the puck detector detects the direction in which the puck passes, and the display modes of the display sections change corresponding to the direction in which the puck passes. This allows an effective improvement in amusement characteristics of match games to be played by two game players.

Also, in the described air hockey game apparatus, the display-mode-setting unit may be arranged to determine a game status, and the display sections may be arranged to display the game status. According to this arrangement, the display modes of the display sections change corresponding to the game status, thereby allowing the game players to appropriately recognize the game status.

Also, the described air hockey game apparatus may further include a display-mode-setting unit made of a timer, wherein the display modes of the display sections are changed corresponding to time measured by the display-mode-setting unit. According to this arrangement, time measured by the timer is displayed on the display sections, thereby allowing the game players to effectively recognize the time.

Furthermore, in the described air hockey game apparatus, the timer constituting the display-mode-setting unit may be arranged to measure time passing in the game, and the display sections may be arranged to display remaining time of the game corresponding to the time passing in the game. According to this arrangement, the game players can recognize final stages of the game according to the remaining time of the game, thereby providing tension characteristics to the game.

DESCRIPTION OF THE PREFERRED EMBODIMENTS

Figure 1:
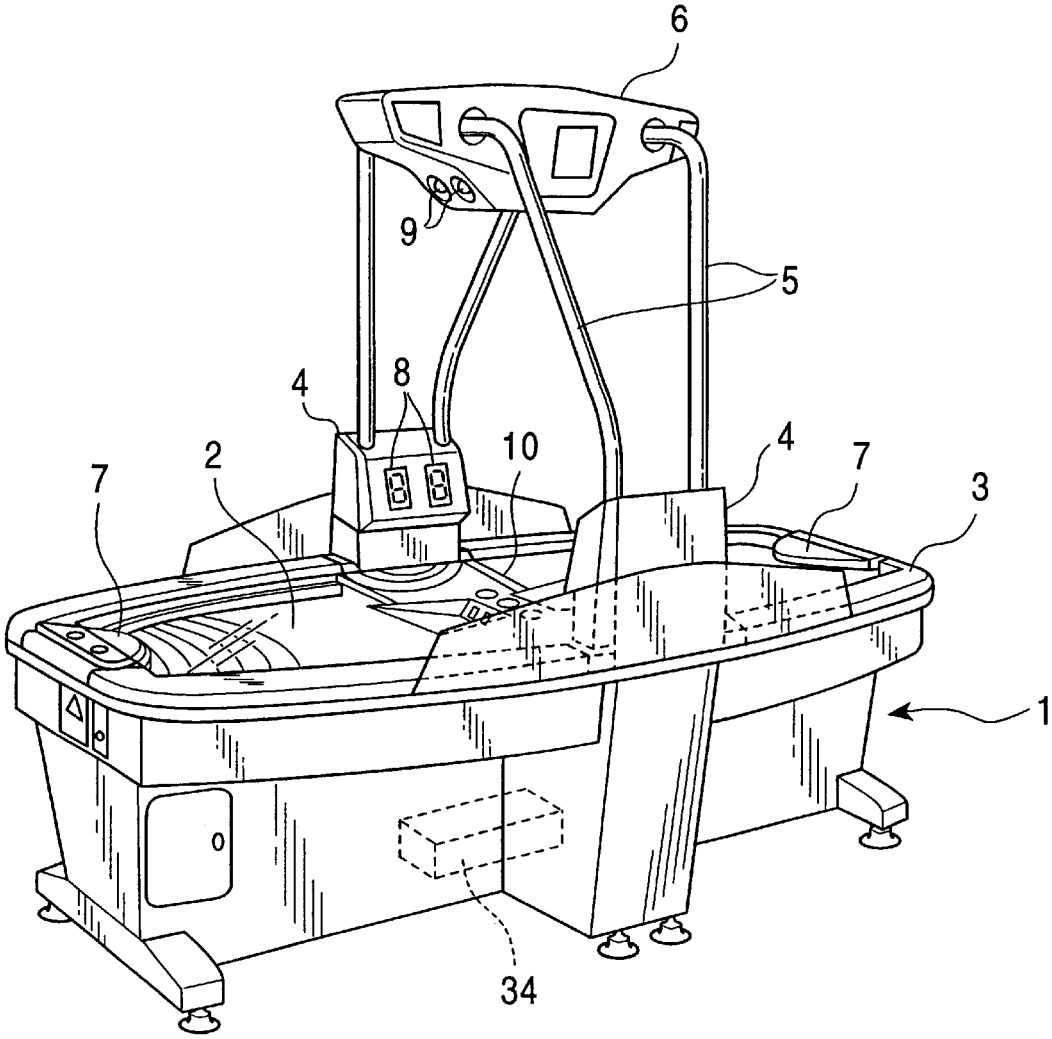
FIG. 1 is a perspective view of an air hockey game apparatus according to an embodiment of the present invention.
Figure 2:
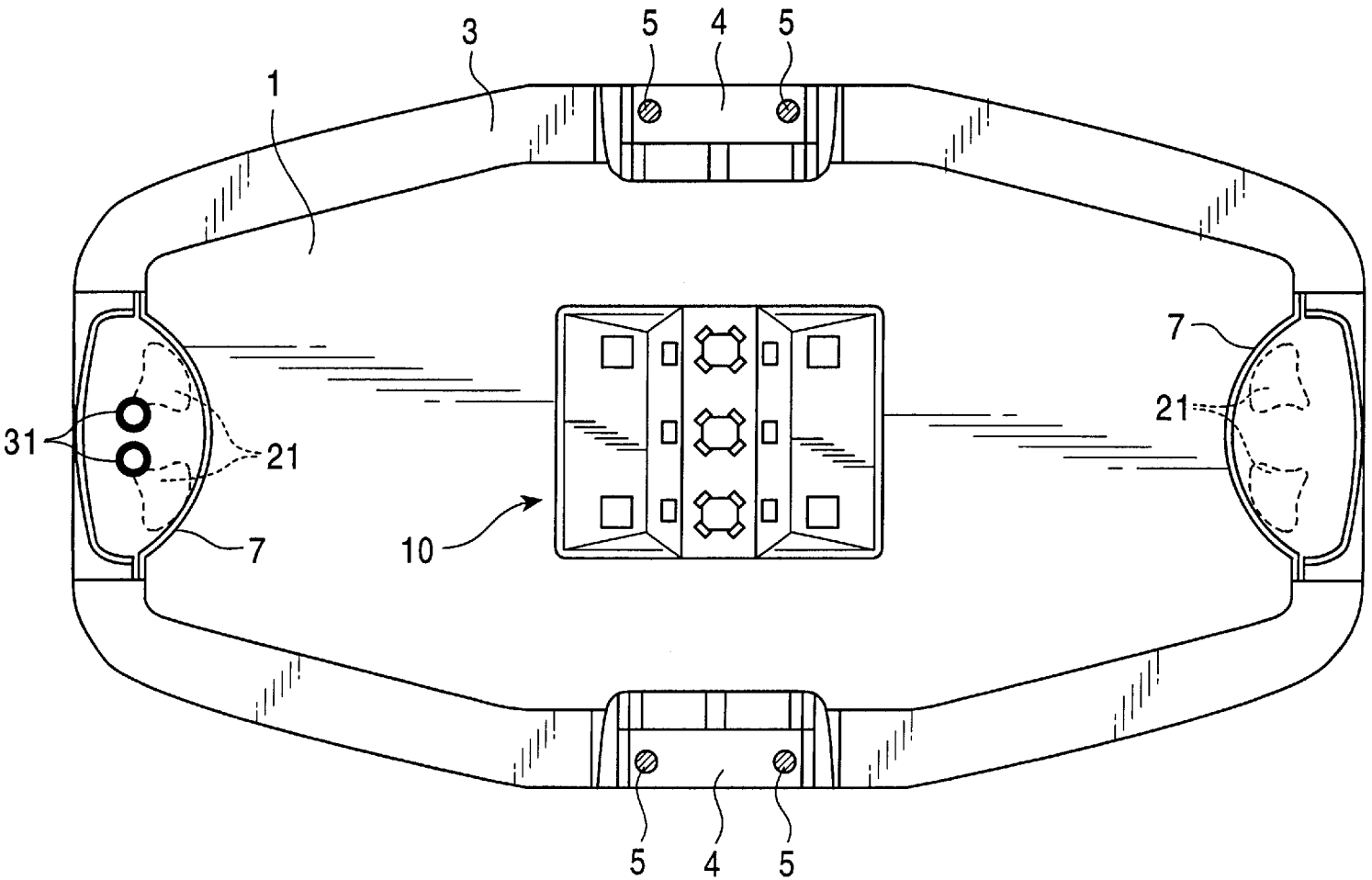
FIG. 2 is a plan view of the overall configuration of the air hockey game apparatus.

FIGS. 1 and 2 show the overall configuration of an air hockey game apparatus according to the present invention.

The air hockey game apparatus has a base 1, a puck sliding surface 2, a peripheral wall section 3 (puck-reflecting frame), a pair of side blocks 4, and an upper block 6. The puck sliding surface 2 is mounted on the base 1. The peripheral wall section 3 surrounds the puck sliding surf ace 2, thereby forming a puck-reflecting frame. The side blocks 4 are provided at right and left side sections of the peripheral wall section 3. The upper block 6 is supported by supporting frames 5 mounted on the pair of side blocks 4. Goals 7 are individually provided at two ends in the front-to-rear direction on the puck sliding surface 2. The individual goals 7 have openings which oppose each other, toward which the puck is hit.

An air-blower 13 (to be described below) for transferring air toward the puck sliding surface 2 is provided in the base 1. Air transferred by the air-blower 13 blows upward from blowholes 40 formed of many small openings (shown in FIG. 3) on the puck sliding surface 2, thereby floating the puck which is shaped like a disc. With the puck floating, individual game players, each holding a hitting tool called a mallet, hit the puck into the goals 7 at the sides of the game player acting as an opponent, thereby competing for scores.

Score displays 8 for displaying scores of the game players are provided on at least one of the side blocks 4. Also, illuminators (not shown) are provided. The illuminators include, for example, spotlights for emitting light toward predetermined positions on the puck sliding surface 2, such as toward the goals 7. An audio unit 9 includes, for example, speakers for producing sound.

Figure 3:
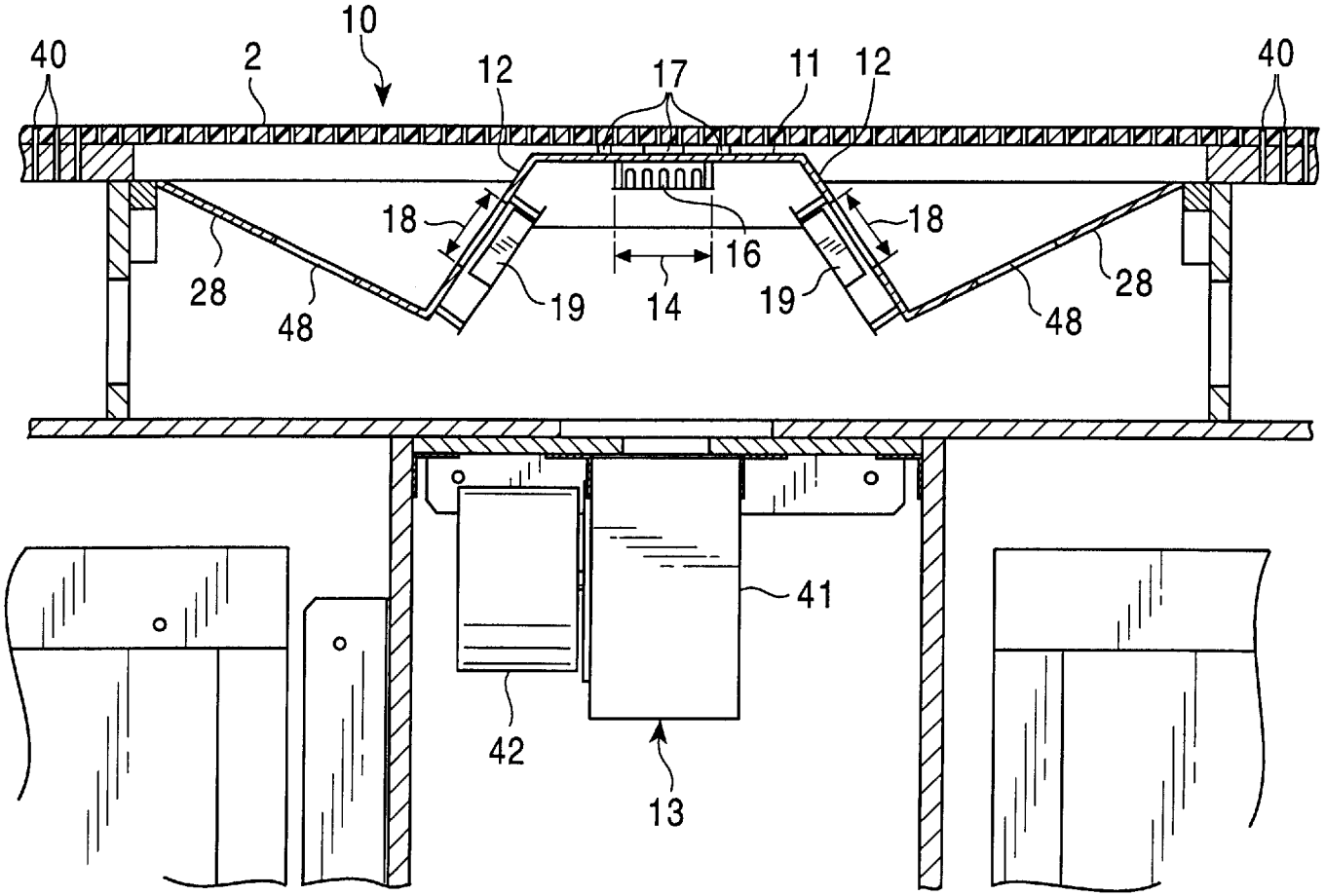
FIG. 3 is a cross-sectional view of the interior configuration of the air hockey game apparatus.
Figure 4:
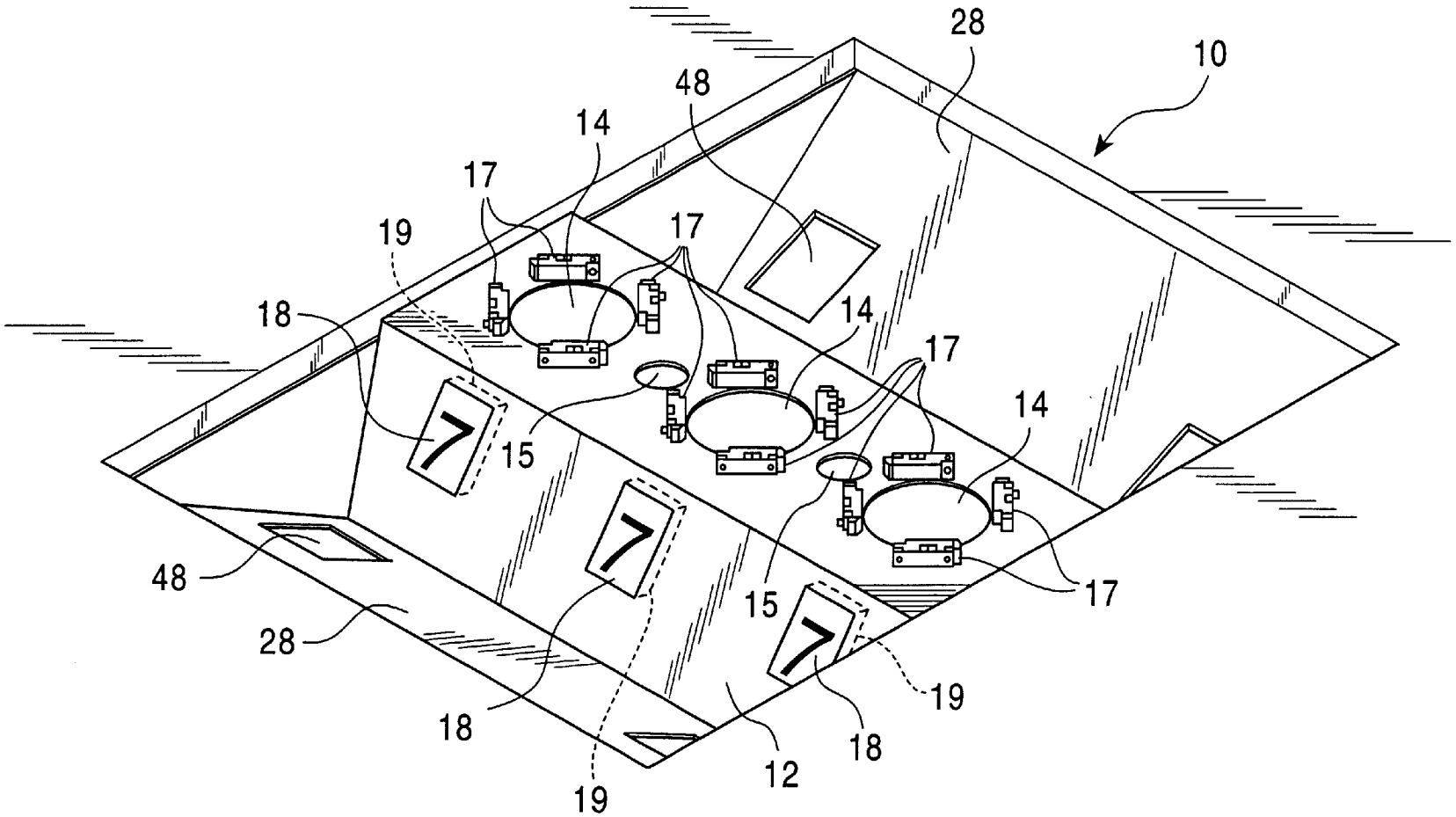
FIG. 4 is a perspective view of the interior configuration of the air hockey game apparatus.

The puck sliding surface 2 is formed of a material, such as an acrylic-resin transparent board, which has transmissive characteristics. Also, as shown in FIGS. 3 and 4, a horizontal plate 11, a pair of sloping plates 12 (display-mounting plates), a pair of sloping plates 28 (partitioning plates), and the air-blower 13 are provided under a central portion 10 of the puck sliding surface 2. The horizontal plate 11 has a predetermined width and extends in a right-to-left direction along a lower surface of the puck sliding surface 2. The individual sloping plates 12 extend diagonally downward from the front and rear ends of the horizontal plate 11. The individual sloping plates 28 extend diagonally upward from ends of the sloping plates 12. The air-blower 13 consists of a blowing fan 41 and a driving motor 42 and is provided under the horizontal plate 11.

The horizontal plate 11 has three large openings 14 serving as air-communicating openings, and two small openings 15 are provided between the large openings 14. Three luminophors 16 (display sections) made of light-emitting diodes are provided so as to face the large openings 14. Four puck detectors 17 individually made of light-sensitive detectors are provided around each of the large openings 14. The puck detectors 17 oppose the puck sliding surface 2 so as to detect the movement of the puck. When the luminophors 16 are turned on to illuminate or to blink, light is emitted upward through the large openings 14 and the puck sliding surface 2 which is transparent. According to this arrangement, the game players can visually recognize the positions where the puck detectors 17 are installed.

Each of the sloping plates 12 has three openings 18 at positions corresponding to the puck detectors 17, and segmented roulette displays 19 are provided so as to face the openings 18. The roulette displays 19 are mounted on the display-mounting plates, i.e., on the sloping plates 12, so as to oppose positions where game players stand at the front end and the rear end of the base 1. Thus, in the above arrangements, the roulette displays 19 are visible through the puck sliding surface 2 which is transparent. Therefore, the game players can see digits or other items displayed on the roulette displays 19.

Also, under the transparent puck sliding surface 2, spaces partitioned by partitioning plates formed of the sloping plates 12, which individually form the display-mounting boards, and the sloping plates 28 are provided. The individual sloping plates 28 have guide openings 48 for guiding air transferred from the air-blower 13. The transferred air is guided into the abovementioned spaces from the guide openings 48 formed on the sloping plates 28 (partitioning plates), the air is then guided to blow up from the puck sliding surface 2 from the blowholes 40 provided on the puck sliding surface 2. In a preferable arrangement, the horizontal plate 11, the sloping plates 12 and 28, the luminophors 16, the puck detectors 17, and the roulette displays 19 are integrated as a single unit. This is preferable because the unit is removable from the base 1.

Figure 5:
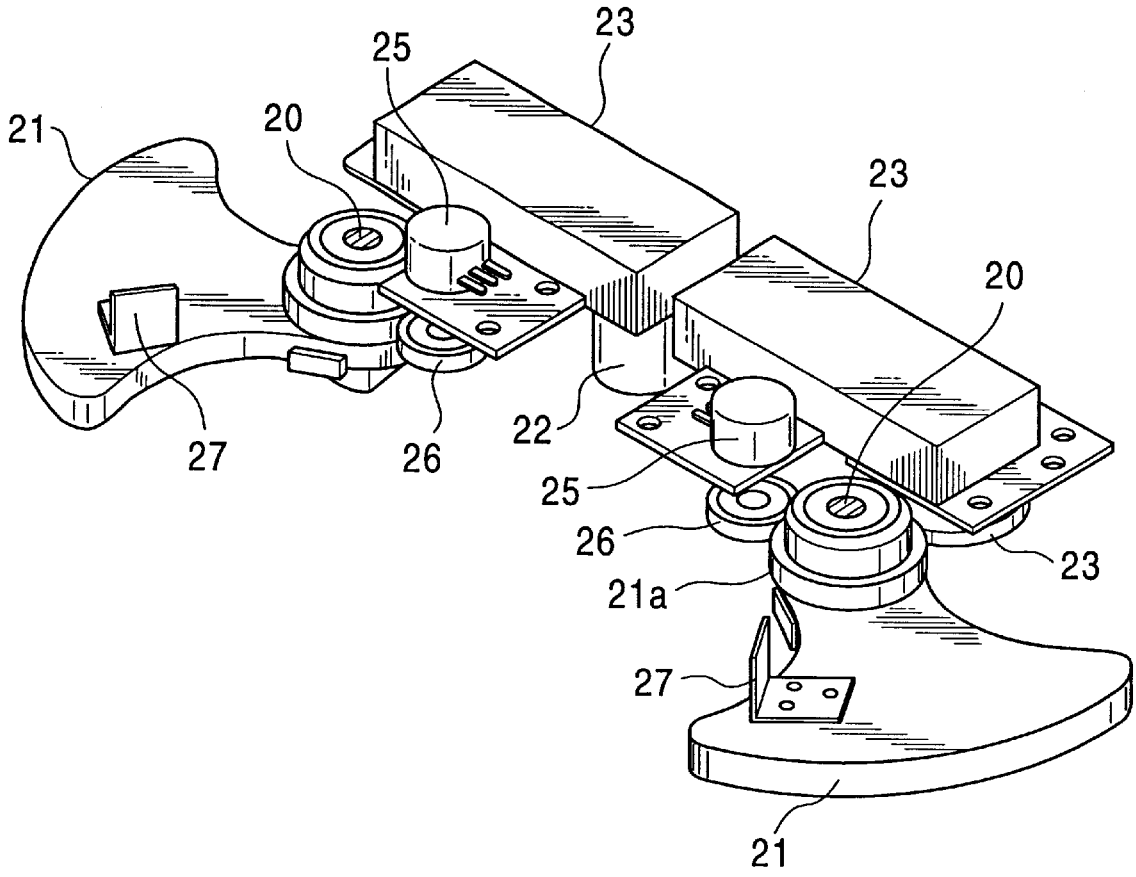
FIG. 5 is a detailed perspective view of the configuration of a driving unit of a blocking member.
Figure 6:
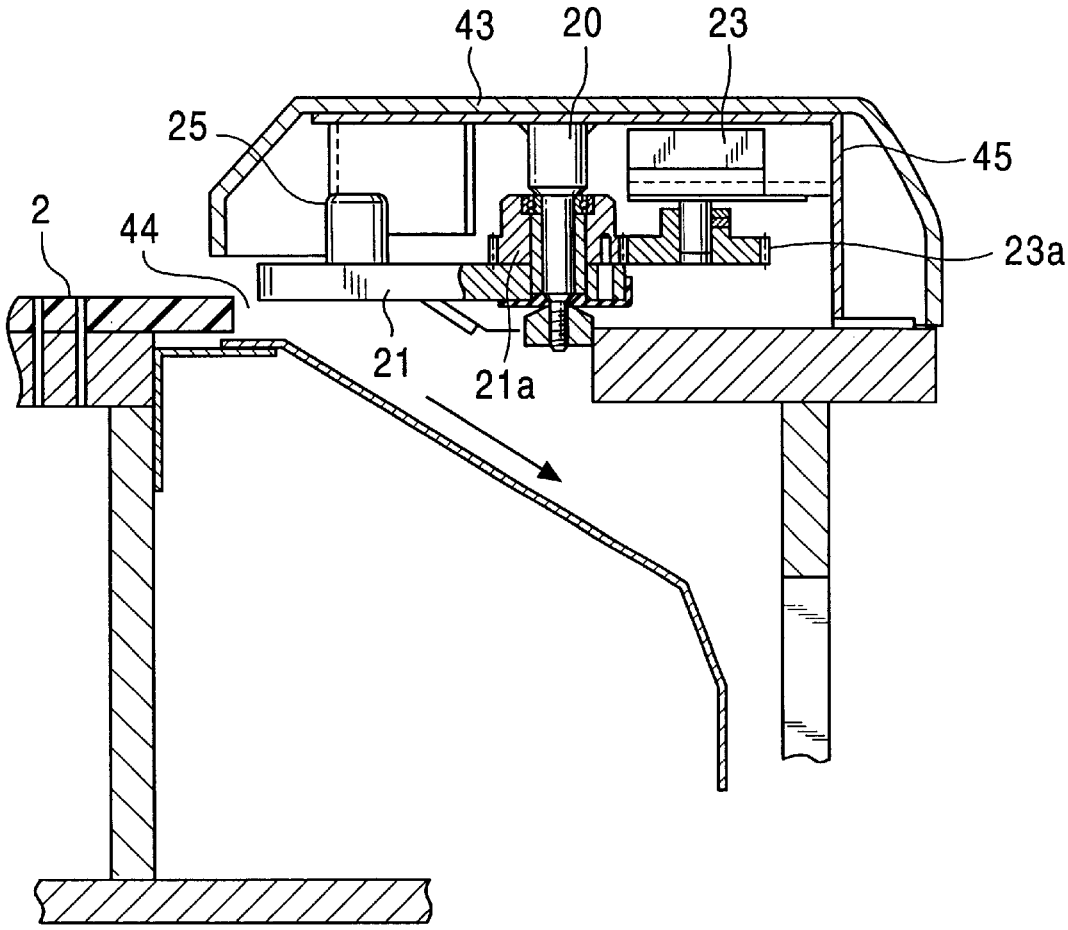
FIG. 6 is a detailed cross-sectional view of a goal.
Figure 10:
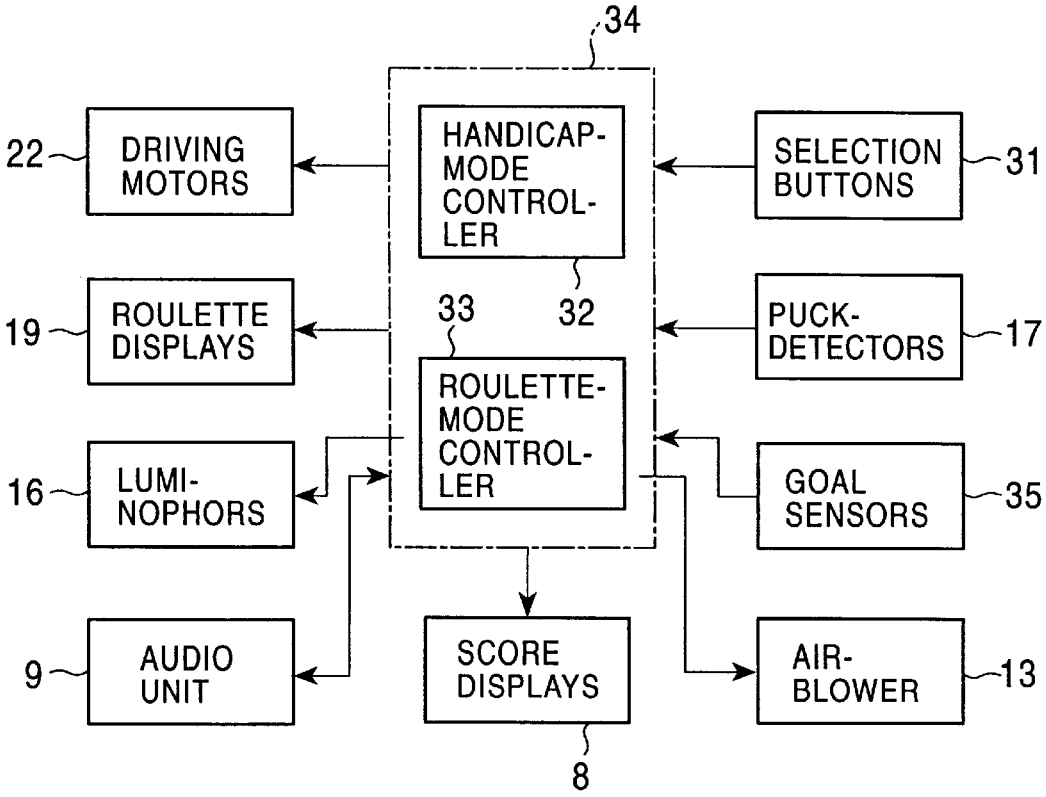
FIG. 10 is a schematic view showing the configuration of a control section in detail.

As shown in FIGS. 5 and 6, each of the goals 7 has an upper cover 43, a puck-passing opening 44, and a goal sensor 35 (goal-detecting unit) (see FIG. 10). The upper cover 43 is provided so as to partly extend inward from the peripheral wall section 3 at positions at the front and rear ends of the puck sliding surface 2, and the puck-passing opening 44 has a cut opening formed. The goal sensor 35, which is made of a passing sensor or the like, is provided in the puck-passing opening 44 and senses the puck hit into the goal 7. For the above, an alternative arrangement may have a goal having a concave section or a convex section on either the puck sliding surface 2 or the peripheral wall section 3. Another alternative arrangement may be such that a goal is simply marked, or a collision sensor or impact sensor may be used as a goal sensor.

Each of the goals 7 also has components such as a supporting bracket 45, a supporting axis 20, a blocking member 21, a driving motor 22, and a power transmission mechanism. The supporting bracket 45 is provided inside the upper cover 43. The supporting axis 20 is symmetric with respect to its right and left sides, extends vertically, and is fitted to the supporting bracket 45. The blocking member 21 is rotatably supported by a vertical axis, that is, the supporting axis 20. The blocking member 21 is formed in an arcuate shape. It has a blocking face spreading as an arc with the vertical axis in the center. The power transmission mechanism consists of components such as a gearbox 23 to be driven by the driving motor 22.

Figure 7:
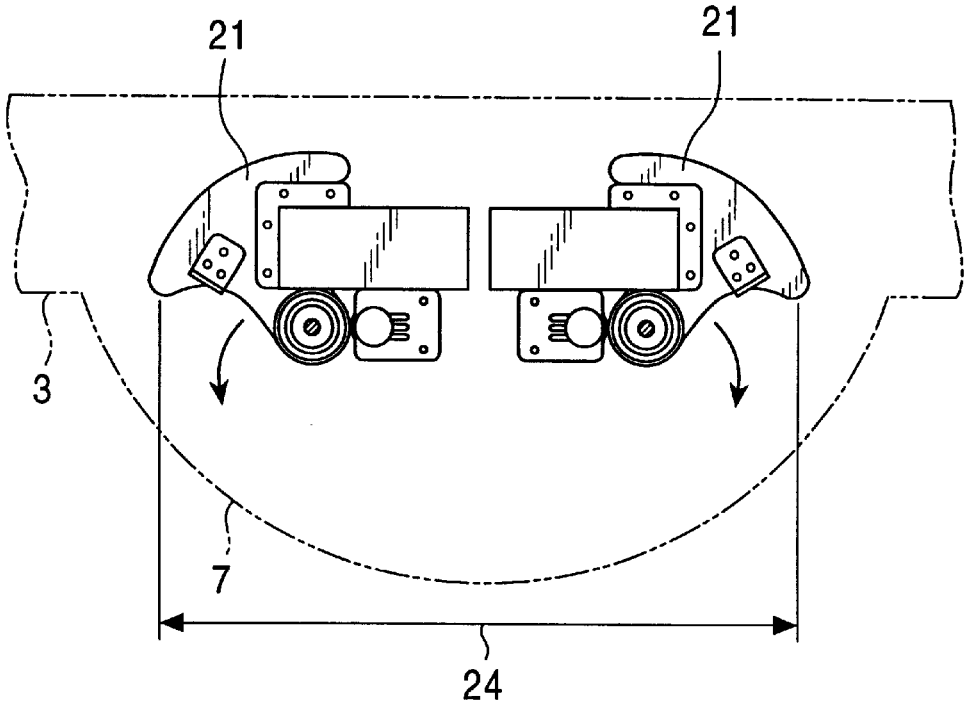
FIG. 7 is a view of the goal when fully open.
Figure 8:
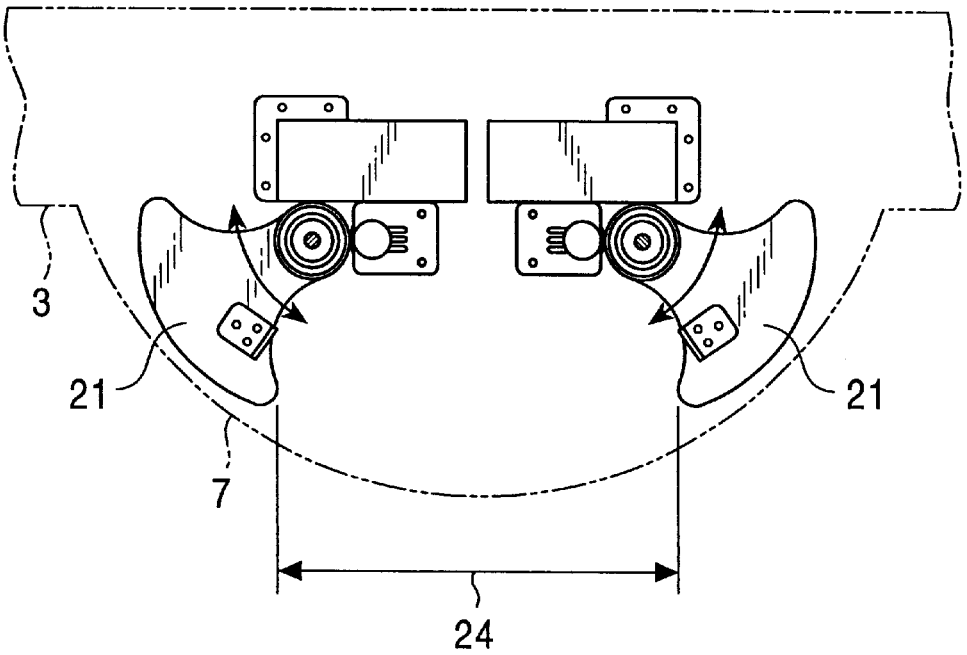
FIG. 8 is a view of the goal when semi-opened.
Figure 9:
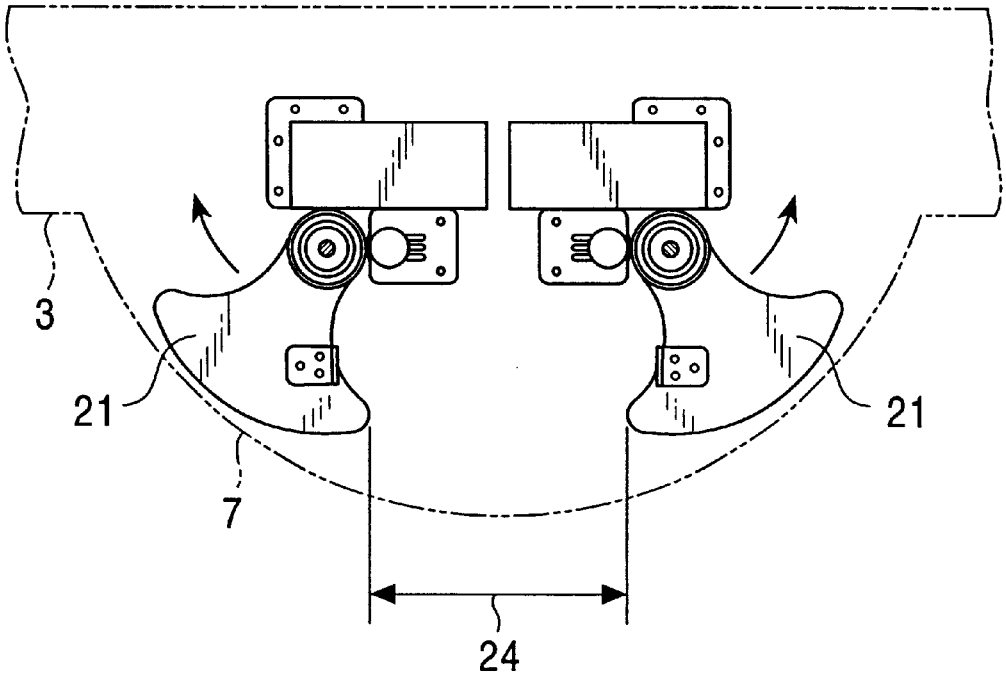
FIG. 9 is a view of the goal in a completely shut state.

With the above configuration, driving power transferred from the driving motor 22 to the gearbox 23 is transmitted via a driving gear 23*a* to a driven gear 21*a* fitted to the blocking member 21. Thereby, the blocking member 21 is allowed to be gradually rotationally displaced from a fully open position shown in FIG. 7 to a semi-open position shown in FIG. 8, and to a completely-shut position shown in FIG. 9.

With the blocking member 21 in the fully open position, an opening 24 provided in the goal 7 becomes fully open, in which state scoring is easiest. In contrast, with the blocking member 21 in the semi-open position, the opening 24 is formed slightly larger than the puck (not shown) in a central portion of the goal 7, thereby causing scoring to be the most difficult. With the blocking member 21 in the completely-shut position, the size of the opening 24 may be set such that the puck cannot enter the goal 7.

The supporting bracket 45 has angle detectors 25 and transmission gears 26. Each of the angle detectors 25 is made of a rotational variable resistor. Each of the transmission gear 26 engages with the driven gear 21*a*, and is rotationally driven according to the rotational displacement of the blocking member 21. The rotational angle of the blocking member 21 is detected by the angle detector 25. Also, stoppers are provided, each consisting of a rotation-stopping plate 27 mounted on an upper surface of the blocking member 21 and a pair of engaging pins (not shown) provided on the supporting bracket 45 so as to protrude. Also, each of the stoppers restricts the rotational range of the blocking member 21, thereby preventing the blocking member 21 from rotating beyond the range between the fully open position and the completely-shut position of the goal 7.

The described air hockey game apparatus has a control unit 34 (control unit) for outputting control signals to the air-blower 13, thereby controlling the air-blowing condition. The control unit 34 has a handicap-mode controller 32 and a roulette-mode controller 33. The handicap-mode controller 32 controls a handicap mode that differentiates the open sizes of the goals according to a signal inputted via operating selection buttons 31. The handicap-mode controller 32 allows the roulette displays 19 to operate according to movement of the puck, and in addition, controls the roulette mode that changes the open sizes of the goals 7 according to results of operation of the roulette displays 19.

The respective selection buttons 31 are, as shown in FIG. 2, a push button for selecting the handicap mode and a push button for selecting the roulette mode. Before the game is started, a user inputs operations using the selection buttons 31 to set a game mode. For the selection buttons 31, a push button for selecting a normal mode may be provided which is used for playing the air hockey game in a normal mode.

The handicap-mode controller 32 is arranged as described in the following paragraphs.

When the handicap mode is selected according to operations of the selection buttons 31, the handicap-mode controller 32 outputs a control signal to the driving motor 22 that drives the blocking members 21, thereby fully opening the goal 7 provided at one end of the puck sliding surface 2. The abovementioned end is assumed to be the end of a first game player. Concurrently, the handicap-mode controller 32 drives the goal 7 provided at the other end of the puck sliding surface 2 to the completely shut state. The abovementioned end is assumed to be the end of a second game player. In this way, the game is started.

During the game, when a score is recognized according to a detection signal outputted from the goal sensor 35 which is formed of the passing sensor, the handicap-mode controller 32 outputs a control signal to the driving motor 22. The control signal changes the open sizes of the goals 7 so that game players can play a game which is suitably adjusted to the difference in skill of the game players. Concurrently, the handicap-mode controller 32 outputs control signals to configuration members, such as the score displays 8, the audio unit 9, the luminophors 16, and the roulette displays 19.

The roulette-mode controller 33 drives the two goals 7 to the completely shut state when the game is started. When movement of the puck is detected by the puck detectors 17, the roulette-mode controller 33 drives the roulette displays 19 to change digital displays. Then, the roulette-mode controller outputs a control signal that drives the goal 7 at the end of the opposing game player to the fully open state, thereby changing the game mode to a chance mode. Concurrently, the roulette-mode controller 33 outputs control signals to other members, such as the audio unit 9, the luminophors 16, and the roulette displays 19, thereby allowing a predetermined performance to be executed.

Figure 11:
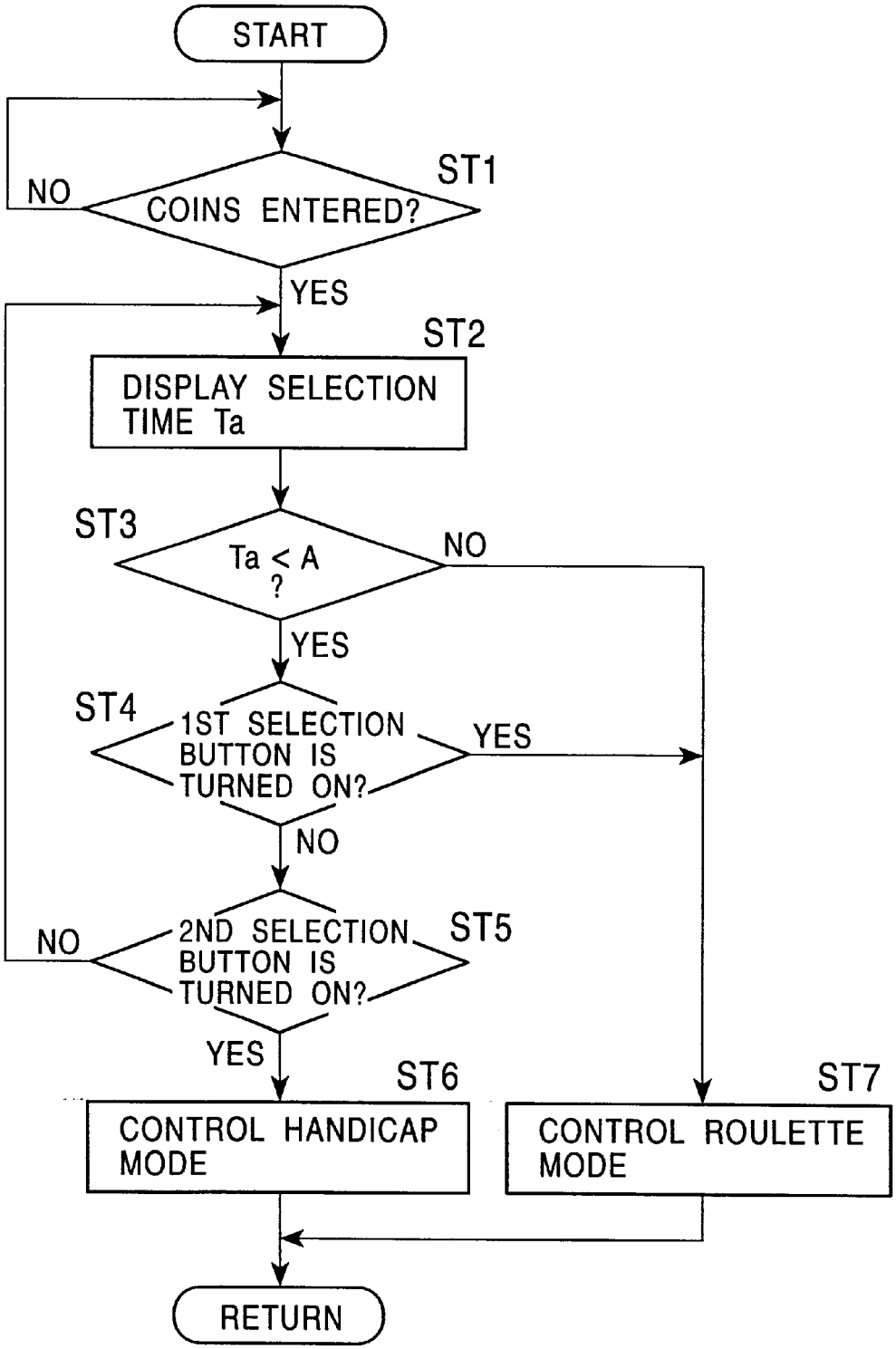
FIG. 11 is a flowchart of basic control processing.

Hereinbelow, with reference to a flowchart in FIG. 11, a description will be given of basic control processing to be executed by the control unit 34.

When the basic control processing is started, step ST1 determines if coins are entered in a coin-entry opening provided at a predetermined position of the air hockey game apparatus. If step ST1 determines the condition to be YES, processing control is passed to step ST2. Step ST2 commands the score display 8 and the roulette displays 19 to individually display a selection time Ta for allowing a game mode to be selected.

Subsequently, step ST3 determines if the selection time Ta is less than a reference time A preset to approximately 30 seconds. If the step ST3 determines the condition to be YES, processing control is passed to step ST4. Step ST4 determines if a first selection button for selecting the handicap mode is turned ON. If step ST4 determines the condition to be NO, processing control is passed to step ST5. Step ST5 determines if a second selection button for selecting the roulette mode is turned ON. If step ST5 determines the condition to be YES, processing control is passed to step ST6. Step ST6 controls the handicap mode described below.

If step ST3 determines the condition to be NO, verifying that the time elapses post the reference time A while neither of the first and second selection buttons is turned ON, step ST7 controls the roulette mode. Step ST7 also controls the roulette mode if step ST4 determines the condition to be YES, verifying that the second selection button is turned ON.

Figure 12:
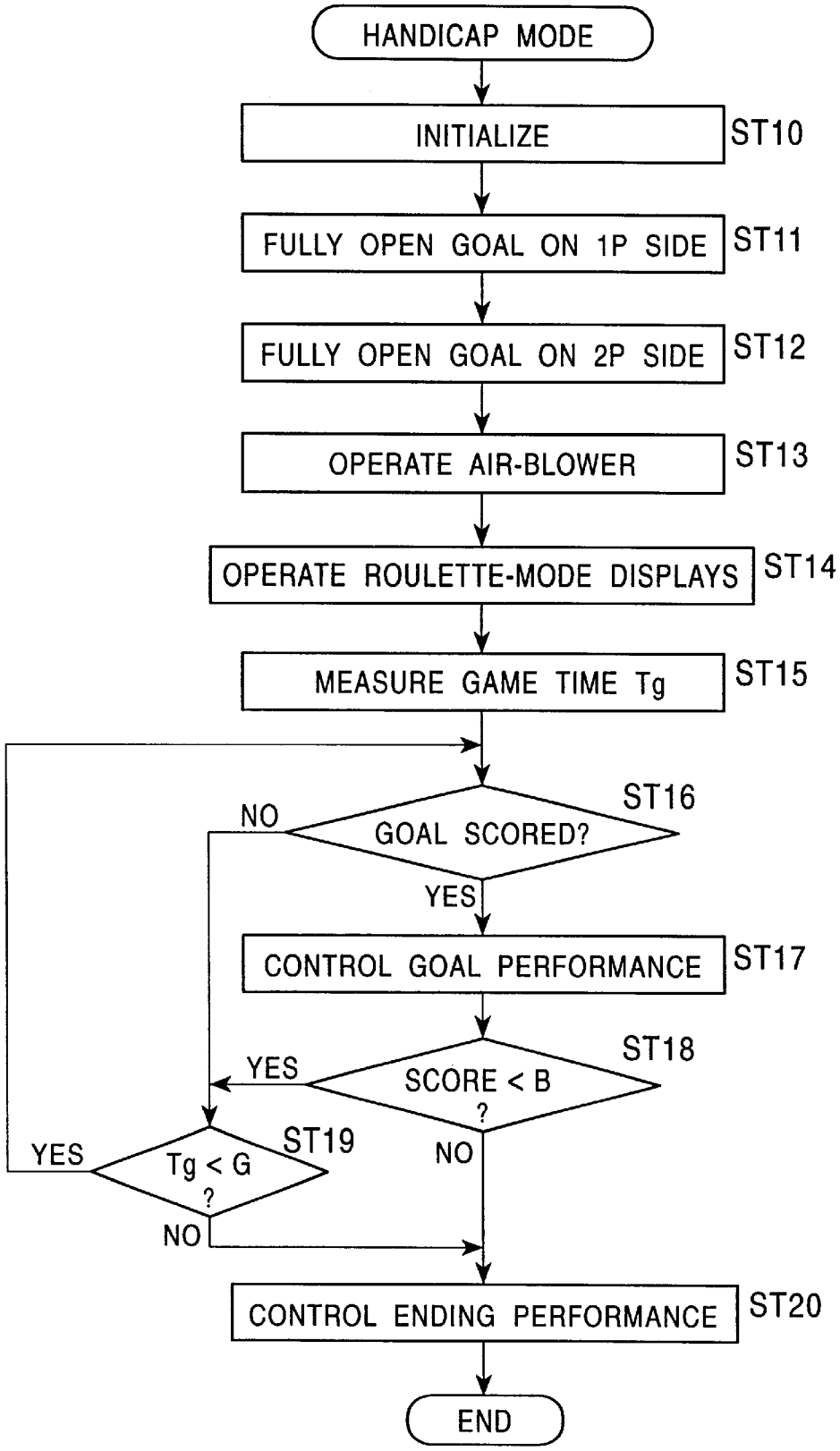
FIG. 12 is a flowchart of control processing in a handicap mode.

Hereinbelow, with reference to a flowchart in FIG. 12, control processing in the handicap mode is described.

Upon starting the control processing, step ST10 performs initialization, resetting various existing values, such as control values. Then, step ST11 causes the goal 7 at the end of a first game player 1P to be in the fully open state. Subsequently, step ST12 outputs a control signal that drives the goal 7 at the end of a second game player 2P to the completely shut state with an opening/closing driving unit made of the driving motor 22.

In step ST13, the air-blower 13 starts blowing air toward the air-communicating openings of the puck sliding surface 2. In step ST14, the roulette displays 19 change numbers digitally displayed. In step ST15, a game time Tg is measured. Subsequently, according to a detection signal outputted by the goal sensor 35, step ST16 determines if one of the first and second game players 1P and 2P has scored a goal. If step ST16 determines the condition to be YES, processing control is passed to step ST17. ST17 controls a goal performance described below. Subsequently, step ST18 determines if the score is lower than a predetermined final score B.

If step ST16 determines the condition to be NO, verifying that no goal has been scored, processing control is passed to step ST19. Step ST19 determines if the game time Tg is less than a predetermined termination time G. Step ST19 also determines the same condition as above if step ST18 determines the condition to be YES, verifying that the score is lower than the predetermined final score B. If step ST19 determines the condition to be YES, it returns processing control to step ST16 so that the described control processing is repeated.

If step ST18 determines the condition to be NO, verifying that the goal score gained by one of the first and second game players 1P and 2P is higher than the final score B, processing control is passed to step ST20. Step ST20 controls an ending performance, and then terminates the control processing. Step ST20 is also performed if step ST19 determines the condition to be NO, verifying that the game time Tg is greater than the termination time G.

Figure 13:
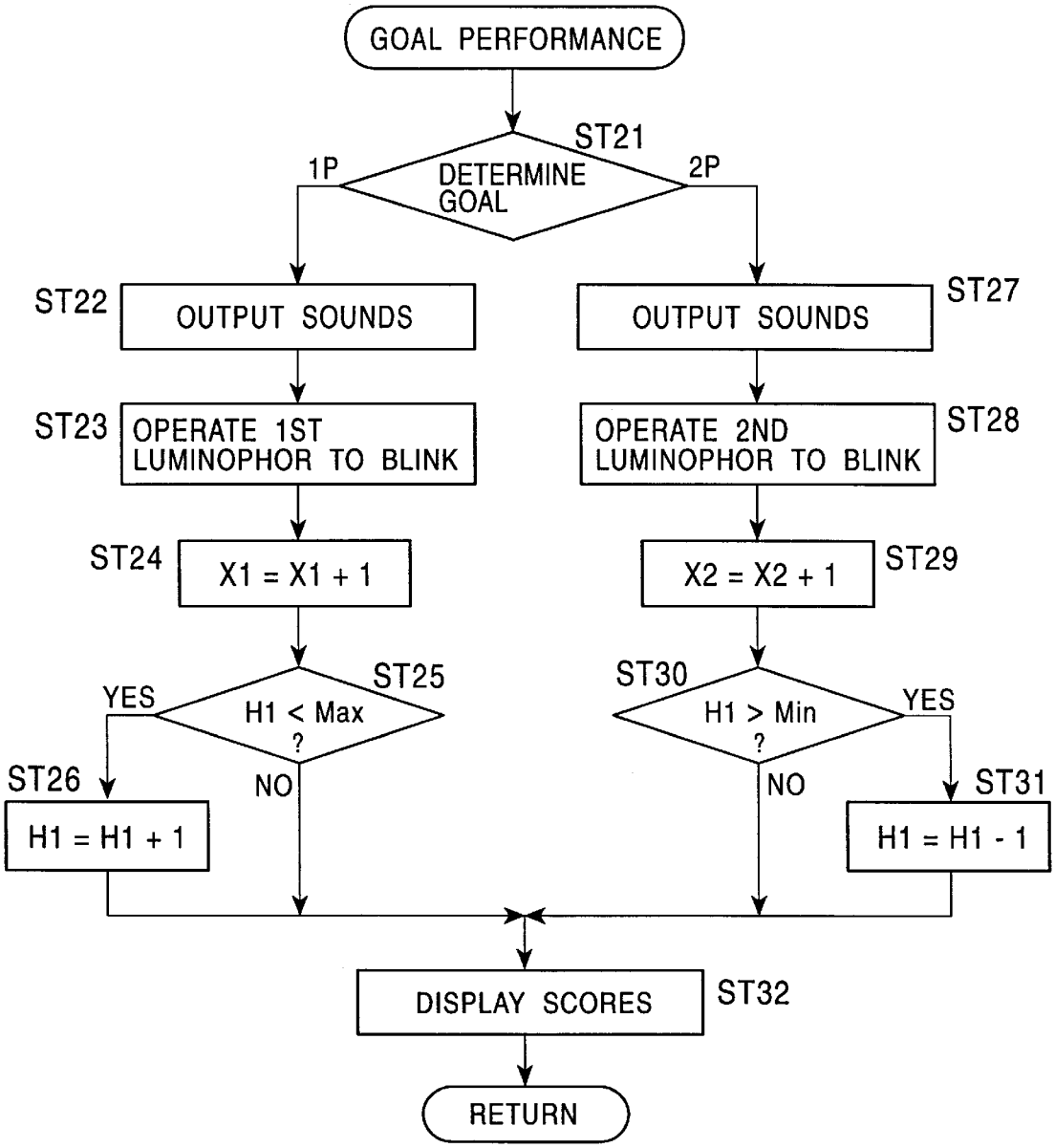
FIG. 13 is a flowchart of control processing in goal performance.

Hereinbelow, with reference to a flowchart in FIG. 13, a description will be given of control processing in the goal performance executed in step ST17 in the handicap mode.

Upon starting the control processing, step ST21 determines which one of the first and second game players 1P and 2P has scored the goal. As a result of the determination in step ST21, if the goal score is verified to have been gained by the first game player 1P, step ST22 commands the audio unit 9 to output predetermined sounds, and also, step ST23 commands a first luminophor to blink. The first luminophor is made of light-emitting diodes arranged in the peripheral wall section 3 at the end of the first game player 1P.

Also, step ST24 adds "1" to a score X1 gained by the first game player 1P and displays it on the score displays 8. Then, step ST25 determines if the open size of the goal 7 at the end of the first game player 1P is smaller than in the fully open state, that is, if a handicap H1 of the first game player 1P is smaller than a maximum value Max. If step ST25 determines the condition to be YES, processing control is passed to step ST26. Step ST26 adds "1" to the handicap H1, thereby increasing the open size of the goal 7 at the end of the first game player 1P by one step. This results in an increase in scoring capacity for the second game player 2P.

As a result of the determination in step ST21, if the goal score is verified to have been gained by the first game player 2P, step ST27 commands the audio unit 9 to output predetermined sounds, and also, step ST23 commands a second luminophor to blink. The second luminophor is made of light-emitting diodes arranged in the peripheral wall section 3 at the end of the second game player 2P.

Also, step ST29 adds "1" to a score X2 gained by the second game player 2P and displays it on the score displays 8. Then, step ST30 determines if the open size of the goal 7 at the end of the first game player IP is greater than that in the completely shut condition, that is, if a handicap H1 of the first game player 1P is greater than a minimum value Min. If step ST30 determines the condition to be YES, processing control is passed to step ST31. Step ST31 subtracts "1" from the handicap H1, thereby reducing the open size of the goal 7 at the end of the first game player 1P by one step. This results in a decrease in scoring capacity for the second game player 2P. Subsequently, step ST32 displays scores gained by the first and second game players 1P and 2P on the score displays 8 and the roulette displays 19, and thereafter, processing control is returned so as to perform control for the handicap mode shown in FIG. 12.

Figure 14:
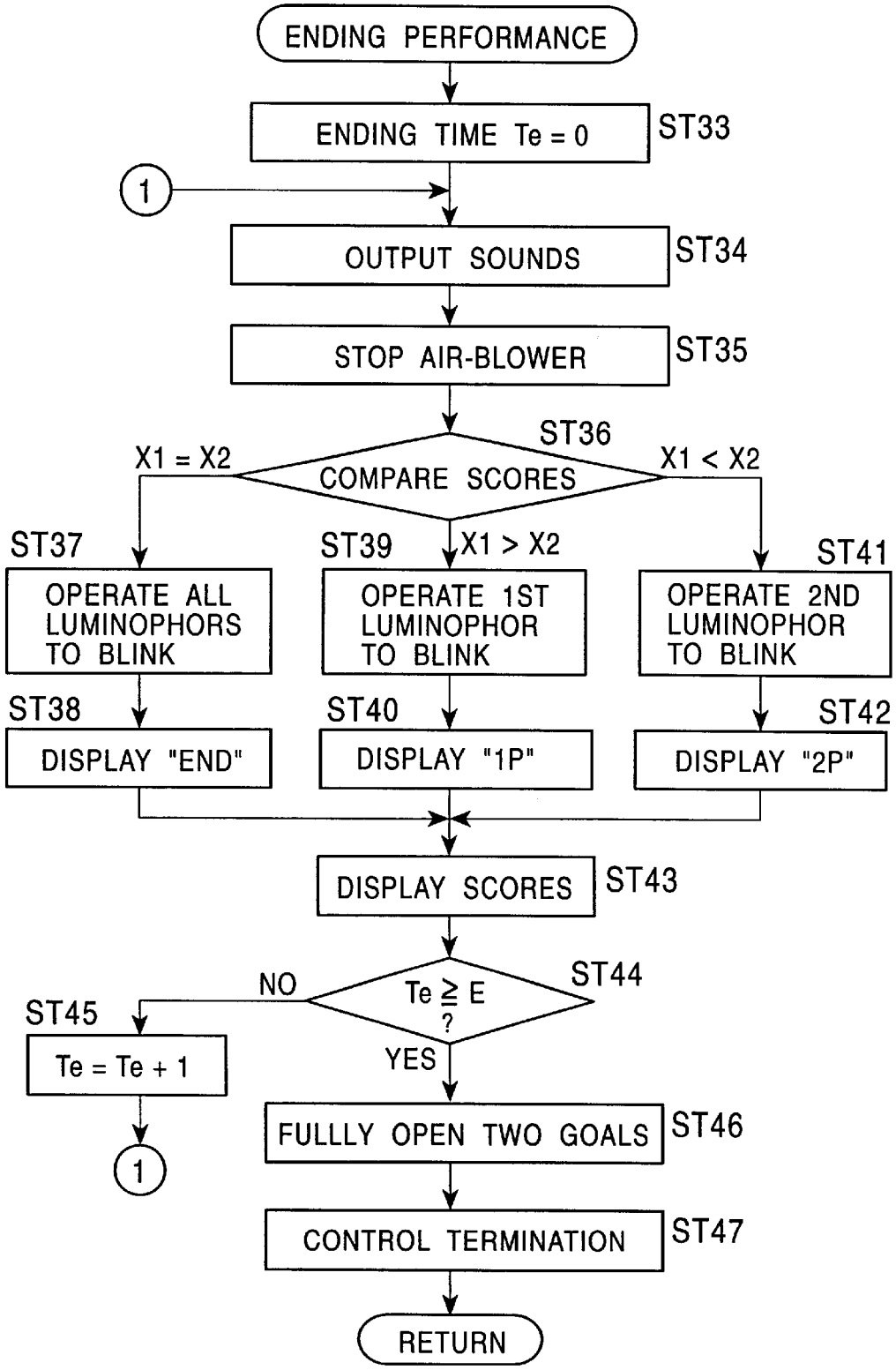
FIG. 14 is a flowchart of control processing in ending performance.

Hereinbelow, with reference to a flowchart in FIG. 14, a description will be given of control processing in the ending performance executed in step ST20 in the handicap mode.

Upon starting the control processing, step ST33 resets an ending time Te to zero, step ST34 commands the audio unit 9 to output sounds, and step ST35 stops the air-blower 13 to terminate air-blowing. Subsequently, step ST36 compares a score X1 gained by the first game player 1P and a score X2 gained by the second game player 2P upon completion of the game. If step ST36 verifies the two scores X1 and X2 to be the same, processing control is passed to steps ST37, and then to ST38. Step ST37 commands all the luminophors provided in the peripheral wall section 3 to blink. Step ST38 commands the individual roulette displays 19 to display "END".

If step ST36 verifies that the score X1 gained by the first game player 1P is higher than the score X2 gained by the second game player 2P, that is, the first game player 1P has won the game, processing control is passed to step ST39. ST39 commands the first luminophor at the end of the first game player 1P to blink. Subsequently, step ST40 commands the roulette displays 19 to display "1P" and the like.

If step ST36 verifies that the score X1 gained by the first game player 1P is lower than the score X2 gained by the second game player 2P, that is, the second game player 2P has won the game, processing control is passed to step ST41. Step ST41 commands the second luminophor at the end of the second game player 2P to blink. Subsequently, processing control is passed to step ST42 that commands the roulette displays 19 to display "2P" and the like.

Subsequently, step ST43 commands the score displays 8 to display the respective scores X1 and X2 gained by the first and second players P1 and P2. Step ST44 determines if the ending time Te exceeds a predetermined reference time E. If step ST44 determines the condition to be NO, processing control is passed to ST45. Step ST45 adds "1" to the ending time Te and returns processing control to step ST34 so that the control processing is repeated.

If step ST44 determines the condition to be YES, processing control is passed to step ST46. In step ST46, a control signal for driving the two goals 7 to the fully open state is outputted to the driving motor 22. Subsequently, step ST47 executes termination control including tasks for turning off all the individual displays and so forth, then returns processing control, thereby terminating the control processing.

Figure 15:
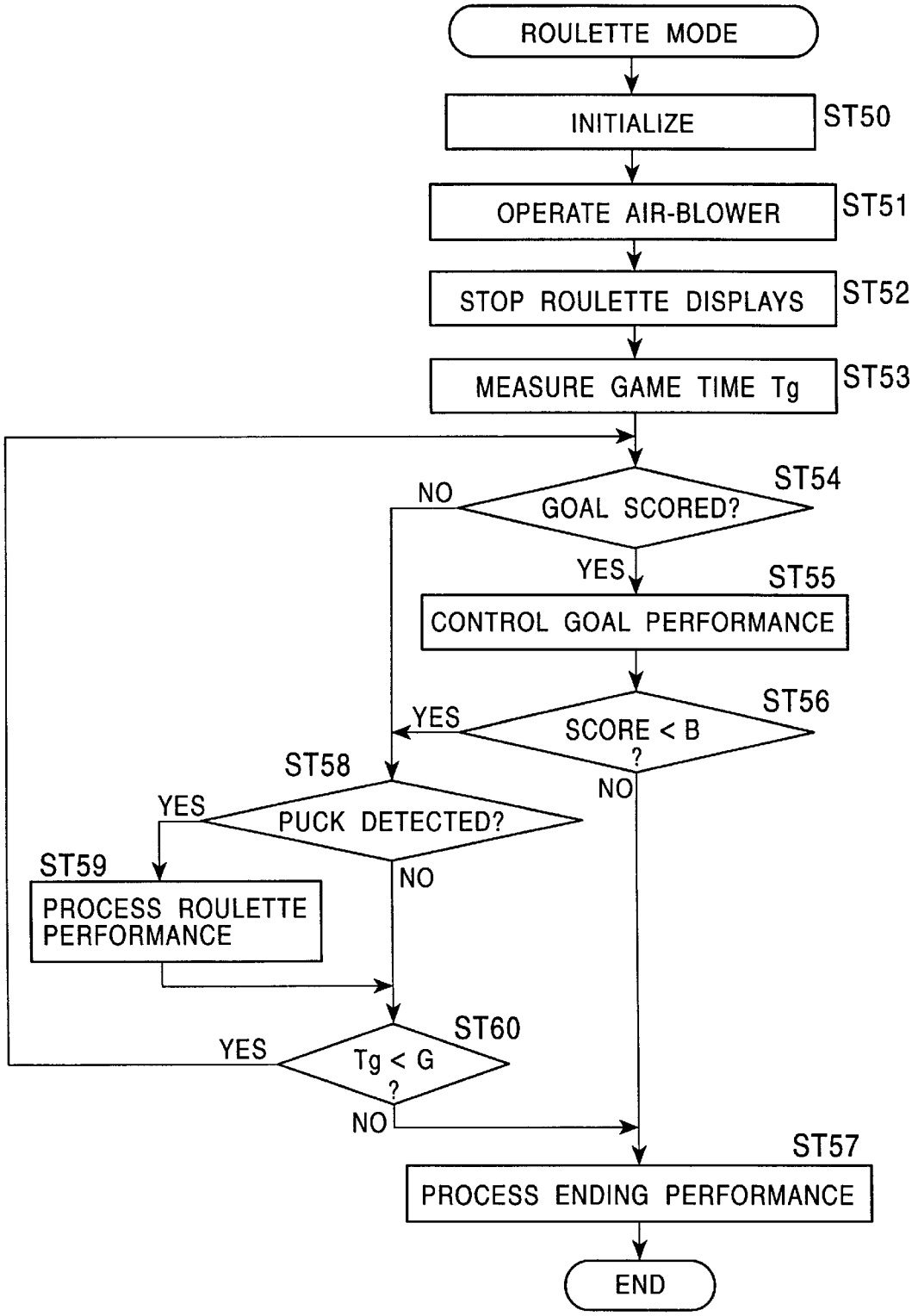
FIG. 15 is a flowchart of control processing in a roulette mode.

Hereinbelow, with reference to a flowchart in FIG. 15, a description will be given of control processing in the roulette mode.

Upon starting the control processing, step ST50 performs initialization, resetting various existing control values and commanding the two goals 7 to be in the completely shut condition. Subsequently, step ST51 commands the air-blower 13 to blow air toward air-communicating openings of the puck sliding surface 2, and step ST52 stops the roulette displays 19. Then, step ST53 starts measurement of the game time Tg.

Subsequently, step ST54 determines if one of the first and second game players 1P and 2P has scored a goal according to a detection signal outputted by the goal sensor 35. If step ST54 determines the condition to be YES, processing control is passed to step ST55. Step ST55 controls the goal performance. Thus, the control processing in the goal performance in the roulette mode is the same as the control processing in the handicap mode except for the following. The control processing in the roulette mode does not include a determination of and the changing operations for the handicap H1 which are performed in steps ST25, ST26, ST30, and ST31 in FIG. 13.

Step ST56 determines if the score is lower than a predetermined final score B. If step ST56 determines the condition to be NO, verifying that the score gained by one of the first and second game players 1P and 2P is higher than the final score B, processing control is passed to step ST57. Step ST57 performs the ending performance shown in FIG. 14, then the control processing terminates.

If step ST54 determines the condition to be NO, verifying that no goals are scored, processing control is passed to step ST58. Step ST58 determines if the puck detectors 17 have detected passage of the puck. Step ST58 is also performed if step ST56 determines the condition to be YES, verifying that the score is lower than the final score B.

If step ST58 determines the condition to be YES, processing control is passed to step ST59. Step ST59 performs control for the roulette performance, and passes processing control to step ST60. Step ST60 determines if the game time Tg is less than a predetermined termination time G. If step ST60 determines the condition to be YES, verifying that the game time Tg is greater than the termination time G, processing control is passed to step ST57, and the control processing terminates.

Figure 16:
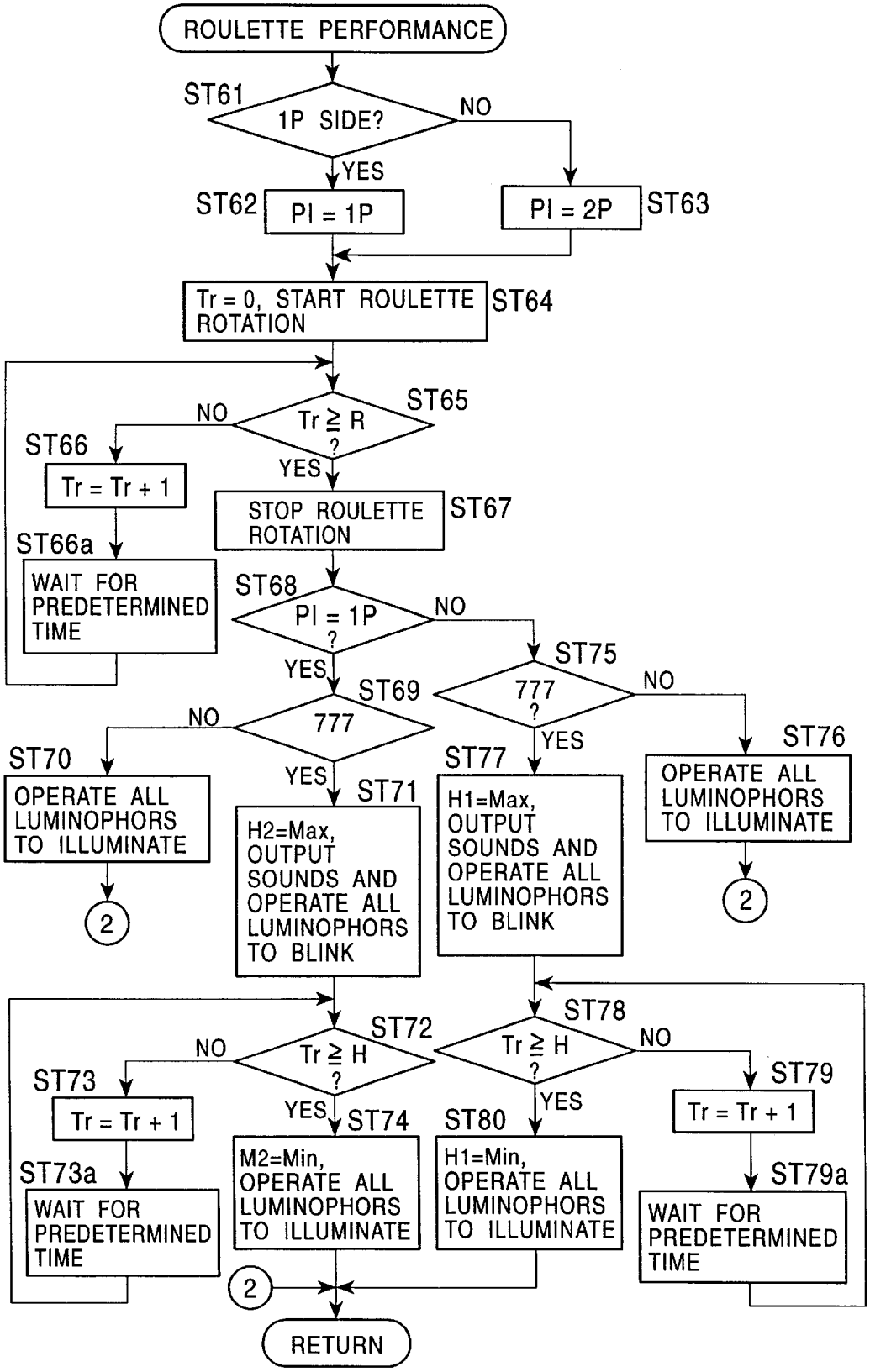
FIG. 16 is a flowchart of control processing in roulette performance.

Hereinbelow, with reference to a flowchart in FIG. 16, a description will be given of control processing in roulette performance performed in step ST59 described above.

Upon starting the operation control, step ST61 determines if the puck detectors 17 have detected the puck hit by the first game player 1P. Specifically, step ST61 determines the direction in which the puck passes according to the order in which detection signals are outputted by the puck detector 17 made of the four light-sensitive detectors provided around the large openings 14. According to the direction determined, step ST61 performs the determination described above.

If step ST61 determines the condition to be YES, verifying that the puck detector 17 has detected the puck hit by the first game player 1P, processing control is passed to step ST62. Step ST62 sets a flag P1 for identifying that game player is set to "1P". On the other hand, if step ST61 determines the condition to be NO, verifying that the puck detector 17 has detected the puck hit by the second game player 2P, processing control is passed to step ST63. Step ST63 sets the flag P1 for identifying the game player to "2P".

Subsequently, step ST64 resets an execution time Tr for roulette performance to zero, commands the roulette displays 19 to operate, and passes processing control to step ST65. Step ST65 determines if the execution time Tr is the same as or greater than a predetermined reference time R. If step ST65 determines the condition to be NO, processing control is passed to step ST66. Step ST66 adds "1" to the execution time Tr and passes processing control to step ST66*a* that awaits an input for a predetermined period of time and returns processing control to step ST65.

If step ST65 determines the condition to be YES, verifying the execution time Tr is the same as or greater than the predetermined reference time R, it passes processing control to step ST67, then to step ST68. Step ST67 commands the roulette displays 19 to stop, and subsequently, step ST68 determines if the flag P1 is set to "1P". If step ST68 determines the condition to be YES, verifying that the flag P1 is set to "P1", processing control is passed to step ST69. Step ST69 determines if the roulette displays 19 display the digits "777". If step ST69 determines the condition to be NO, verifying that the roulette displays 19 display digits other than the digits "777", processing control is passed to step ST70. Step ST70 turns on all the luminophors 16 to illuminate, and returns processing control to the control processing in the roulette mode shown in FIG. 15.

If step ST69 determines the condition to be YES, verifying that the roulette displays 19 display the digits "777", processing control is passed to step ST71. Step ST71 sets a handicap H2 for the second game player 2P to the maximum value Max and causes the open size of the goal 7 at the end of the second game player 2P to be in the fully open state.

Also, step ST71 commands the audio unit 9 to output predetermined sounds and commands all the luminophors 16 to blink.

Subsequently, step ST72 determines if the execution time Tr for the roulette performance is the same as or greater than a termination time H for the chance mode. If step ST72 determines the condition to be NO, processing control is passed to step ST73. Step ST73 adds "1" to the execution time Tr, then passes processing control to step ST73*a* that awaits for a predetermined period of time for an input and returns processing control to step ST72.

If step ST72 determines the condition to be YES, verifying that the execution time Tr for the roulette mode matches or exceeds the termination time H for the chance mode, processing control is passed to step ST74. Step ST74 sets the handicap H2 for the second game player 2P to the minimum value Min and returns the open size of the goal 7 at the end of the second game player 2P to the completely shut state and turns on all the luminophors 16. Then, step ST74 returns processing control to the control processing in the roulette mode shown in FIG. 15.

If step ST68 determines the condition to be NO, verifying that the flag P1 is set to "2P", step ST75 determines if the roulette displays 19 display the digits "777". If step ST75 determines the condition to be NO, verifying that the roulette displays 19 display digits other than the digits "777", processing control is passed to step ST76. Step ST76 turns on all the luminophors 16 to illuminate and returns processing control to the control processing in the roulette mode shown in FIG. 15.

If step ST75 determines the condition to be YES, verifying that the roulette displays 19 display the digits "777", processing control is passed to step ST77. Step ST77 sets the handicap H1 for the first game player 1P to the maximum value Max and causes the open size of the goal 7 at the end of the first game player 1P to be in the fully open state. Also, step ST77 commands the audio unit 9 to output predetermined sounds and commands all the luminophors 16 to blink.

Subsequently, step ST78 determines if the execution time Tr for the roulette mode is the same as or greater than the termination time H set for chance mode. If step ST78 determines the condition to be NO, processing control is passed to step ST79. Step ST79 adds "1" to the execution time Tr, and subsequently, step ST79*a* awaits an input and returns processing control to step ST78.

If step ST78 determines the condition to be YES, verifying that the execution time Tr for the roulette performance is the same as or greater than the termination time H set for the chance mode, processing control is passed to step ST80. Step ST80 sets the handicap H1 for the first game player 1P to the minimum value Min and returns the open size of the goal 7 at the end of the first game player 1P to the completely shut state. Also, step ST80 turns on all the luminophors 16 to illuminate, and returns processing control to the roulette mode shown in FIG. 15.

As described above, the air hockey game apparatus has the puck sliding surface 2 having blowholes 40 for air for floating the puck, the air-blower 13 for transferring air into the blowholes 40, the peripheral wall section 3 as the puck-reflecting frame around the puck sliding surface 2, and the goals 7 on the puck sliding surface 2, thereby allowing competition for entering the puck into the goals 7. Furthermore, the air hockey game apparatus has the puck sliding surface 2 made of the transparent material, display sections made of the roulette displays 19 and the luminophors 16 under the puck sliding surface 2, the display-mode-setting unit made of the control unit 34 for setting the display mode, thereby controlling the display sections to be in the set display mode. This allows the game players to appropriately recognize the display mode of the display section, thereby providing predetermined information to the game players.

Also, the described embodiment has display-mounting plates made of the sloping plates 12 provided under the puck sliding surface 2 made of the transparent board. The display-mounting plates individually oppose positions where the game players stand, and the individual roulette displays 19 are provided on the display-mounting plates. This allows the game players to effectively view the roulette displays 19 and to appropriately recognize the display mode of the display sections.

Also, the described embodiment has spaces partitioned by partitioning plates individually having the sloping plates 12 (display-mounting plates). The individual sloping plates 28 have the guide openings 48 for guiding air blown by the air-blower 13. The air from the air-blower 13 is guided from the guide openings 48 to the aforementioned spaces, then, the air is blown up onto the surface of the puck sliding surface 2. Thereby, the puck hit over the aforementioned spaces can be effectively floated.

As described above, the display sections made of the roulette displays 19 and luminophors 16 are provided under the puck sliding surface 2. This allows the game players who keep their eye on the puck moving on the puck sliding surface 2 to appropriately recognize the display modes and to obtain the predetermined changeable information in the display sections without being forced to remove their eyes from the puck.

Also, as described above, the embodiment has a goal-detecting unit made of the goal sensor 35 for detecting the puck entered into each of the goal 7. According to the detection unit outputted from the goal-detecting unit, the display-mode-setting unit made of the control unit 34 sets the display modes. This allows the game players who view the display modes to explicitly recognize scores that they have gained by achieving goals. That is, as described in the embodiment, according to the arrangement made such that, when the goal-detecting unit made of the goal sensor 35 detects a scored goal, the score is displayed, the game players can therefore clearly see the score, and thereby, amusement characteristics of the game can be effectively improved.

Furthermore, the described embodiment has the puck detectors 17 for detecting movement of the puck. The puck detectors 17 are provided in a position opposing the puck sliding surface 2. When the puck detectors 17 detect movement of the puck, the display-mode-setting unit is operated to set the display modes. With this arrangement, according to changes in the display modes of the roulette displays 19, changing characteristics can be given to the game. For example, although specific digits "777" are displayed on the roulette displays 19, as described above, variations can be given to the game by changing the open angles of the goals 7 so as to set the chance mode. The variation in the game allows an effective improvement in excitement the game players feel.

Also, as in the described embodiment, the puck detectors 17 for detecting the puck passing on the puck sliding surface 2 are provided in the position opposing a specific portion of the puck sliding surface 2. In this arrangement, when the puck detectors 17 detect the passage of the puck, the display-mode-setting unit is operated to set the display modes. With this arrangement, the game player who hits the puck by targeting the installation portion of the goal 7 can enjoy advantages during the game. This provides a significant improvement in amusement characteristics of the game, compared to conventional apparatuses which simply allow a game player to hit a puck towards a goal.

Also, the described embodiment has the puck detectors 17 made of the multiple light-sensitive detectors under the puck sliding surface 2. The embodiment thereby detects the direction in which the puck passes and changes the display modes of the display sections made of the roulette displays 19 corresponding to the direction in which the puck passes. This provides an effective improvement in amusement characteristics of match games to be played by two game players with the air hockey game apparatus.

In the above embodiment, a description has been given of the example in which the luminophors 16 are provided in the installation portions of the puck detectors 17, and these portions are operated to illuminate to allow the game players to see the installation portion and to hit the puck toward these portions. However, an arrangement may be such that identifiers such as bumpers, tunnel areas, targets, or simple display sections are provided, thereby allowing the game players to appropriately see the installation portions of the puck detectors 17.

In addition, the described air hockey game apparatus may be arranged to use the display-mode-setting unit in order to judge a game status, for example, to judge if a currently progressing game is set to the chance mode. This arrangement allows the game players to effectively recognize attacking chances corresponding to the chance mode, thereby allowing amusement characteristics of the air hockey game apparatus to be improved even more effectively.

Also, an arrangement may be such that the control unit 34 includes a display-mode-setting unit made of a timer, in which the display modes of the display sections are changed corresponding to time measured by the display-mode-setting unit. This arrangement effectively allows the game players to recognize the time measured by the display-mode-setting unit. An example arrangement may be such that the timer measures time passing in the game, and remaining time of the game is displayed. This arrangement allows the game players to recognize, for example, that the game is in a final stage, thereby allowing tension characteristics to be provided to the game.

Also, the described embodiment has the blocking members 21 in the goals 7, sets of opening/closing driving units individually having driving motors 22 that drive the opening/closing driving units to change the open angles of the goals 7, and the controller made of the control unit 34 for controlling the driving motors 22. In this arrangement, the blocking members 21 are individually driven by the driving motors 22, and the goals 7 are individually opened or shut by the driving motors 22, thereby changing the open angles of the goals 7. This provides dynamic characteristics to the game, thereby improving amusement characteristics of the game. Concurrently, the open angles of the goals 7 can be easily changed even during the game.

For example, as in the described embodiment, the open angles of the goals 7 are gradually changed corresponding to scores gained by the game players so that one of the game players who has gained a higher score is placed in a disadvantageous position. This arrangement is advantageous in that the game can be played for fair and strong competition, and thereby, effective improvement in amusement characteristics can be achieved. In the above embodiment, the description has been given of the arrangement in which only the open angle of the goal 7 at the end of the first game player 1P according to scores gained by the first and second game players 1P and 2P in control in the handicap mode. However, there are no restrictions to the above. In this regard, an arrangement may be such that the open angle of the goal 7 at the end of the second game player 2P is changed, or the open angles of the goals 7 at the ends of both the first and second game players 1P and 2P are changed.

Also, although the described embodiment has the pair of goals on the puck sliding surface 2, there are no restrictions to it. For example, only one of the single goals 7 may be provided to allow a single game player to enjoy the game. However, with the pair of goals 7 provided on the puck sliding surface 2 as in the case of the described embodiment, two game players can enjoy match games that allow competition for scores.

Also, as described above, the described embodiment has the pair of goals 7 at the front and rear ends of the puck sliding surface 2. As an alternative arrangement, however, three or more goals may be provided to allow three or more game players to compete with each other. Also, another alternative arrangement may be such that the pair of goals 7 is provided at two ends of a puck sliding surface 2 having a U shape or a V shape, in which the puck hit by game players enters into the goal 7 on the opposing side via U-shaped portions or V-shaped portions.

Also, instead of the puck detectors 17 made of light-sensitive detectors, sensors such as impact sensors, pushing sensors, contact sensors, light-reflection sensors, or the like may be used. Also, if a puck made of a magnetic material is used, the puck detectors 17 may be made of magnetic sensors. Also, in the above embodiment, the description is given of the example that has the entire puck sliding surface 2 made of the transparent material. However, an arrangement may be such that at least one portion of the puck sliding surface 2, which corresponds to the position where the roulette displays 19 are provided, is transparent.

Also, the installation portions of the puck detectors 17 need not be provided in the central portions of the puck sliding surface 2, and may be provided in other portions. In this connection, an arrangement may be such that the puck detectors 17 for detecting movement of the puck are arranged at least in a portion, wherein, when the puck detectors 17 detect movement of the puck, the display-mode-setting unit is operated to set the display modes of the display sections. Also, an arrangement may be such that when the individual goal sensors 35 detect either movement of the puck or a goal operation, the roulette displays 19 are operated to change digits displayed on the roulette displays 19.

Also, an arrangement may be such that irregularly reflecting areas with, for example, concave portions, notches, convex portions, and openings are provided so that the puck irregularly bounces. This arrangement allows dynamic characteristics of the game to be improved even more effectively.

Also, the blowholes 40 formed on the puck sliding surface 2 need not be arranged at uniform pitches, but may be arranged at smaller pitches depending on the areas, thereby providing areas with high densities of the blowholes 40. For example, areas with a high density of the blowholes 40 may be provided at two sides of the goal 7 so that the puck is easily induced into the goal 7. Alternatively, for example, areas with a high density of the blowholes 40 may be provided in the vicinity of the puck detectors 17 made of light-sensitive detectors provided in the central portions of the puck sliding surface 2 so that the puck is induced to approach portions where the puck detectors 17 are installed.

Figure 17:
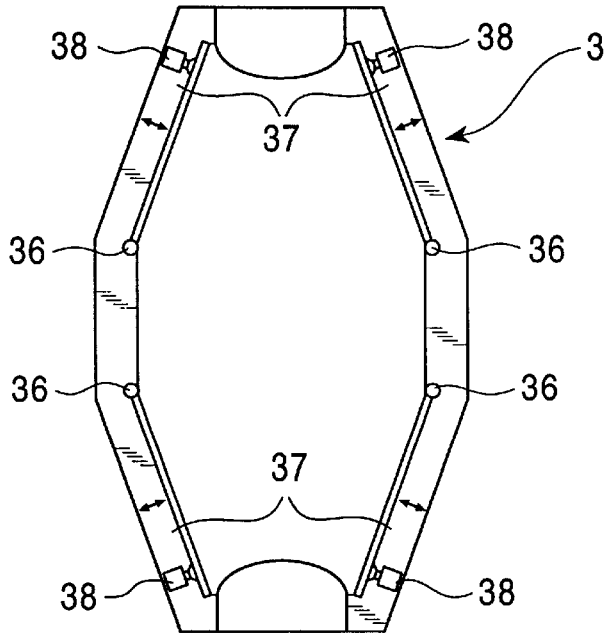
FIG. 17 is a view of a different embodiment of the air hockey game apparatus according to the present invention.

Also, as shown in FIG. 17, an arrangement may be such that reflecting boards 37 and driving units 38 are provided, wherein the reflecting boards 37 vibrate with the support of vibrating axes 36, and the driving units 38 are made of a driving cylinder or a push-pull solenoid that cause the reflecting boards 37 to vibrate. Also, the driving units 38 are operated according to the game status, and installation angles of the reflecting boards are changed, thereby allowing goal-scoring to be easy or difficult. This arrangement also provides dynamic characteristics to the game.

Figure 18:
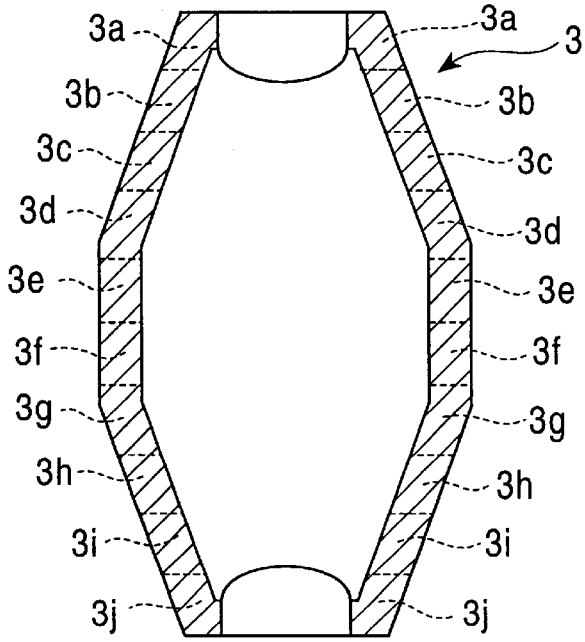
FIG. 18 is a view of a different embodiment of the air hockey game apparatus according to the present invention.

Also, as shown in FIG. 18, an arrangement may be such that the peripheral wall section 3 positioned at the left and right lateral sides is partitioned in multiple blocks 3*a* to 3*j*, luminophor which illuminates in two different colors corresponding to the two game players in the blocks 3*a* to 3*j* are individually provided, and the illumination color is changed corresponding to scores or the like that the game players obtain. In this configuration, since the illumination color of the blocks 3*a* to 3*j* changes corresponding to the difference in scores, an advantage can be provided in that the game-scoring status can be recognized even more quickly.

As above, while the present invention has been described with reference to what are presently considered to be the preferred embodiment, it is to be understood that the invention is not limited to the described embodiment and modifications. On the contrary, the invention is intended to cover various other modifications and equivalent arrangements included within the spirit and scope of the invention.

What is claimed is:

1. An air hockey game apparatus comprising:

a puck sliding surface having blowholes for blowing air to float a puck and having at least one transparent portion;

air-blowing means for blowing and sending air toward blowholes;

a puck-reflecting frame around the puck sliding surface;

goals on the puck sliding surface;

display sections provided under the transparent portion, of which a display mode is changeable; and display-mode-setting means for setting the display mode of the display sections, thereby controlling the display sections so as to be in the set display mode.

2. An air hockey game apparatus as claimed in claim 1, further comprising display-mounting plates under the transparent portion so as to oppose positions where game players stand, wherein the display sections are provided on the display-mounting plates.

3. An air hockey game apparatus as claimed in claim 2, further comprising:

partitions defining space therebetween, said partitions individually having the display-mounting plates, and said partitions each is formed with a guide opening which guides the air transferred from the air-blowing means.

4. An air hockey game apparatus as claimed in one of claims 1 to 3, further comprising puck detectors in at least one portion of the puck-reflecting frame, wherein the display-mode-setting means sets the display modes of the display sections.

5. An air hockey game apparatus as claimed in claim 4, wherein the display-mode-setting means determines a game status and allows the display sections to display the game status.

6. An air hockey game apparatus as claimed in claim 4, wherein the display-mode-setting means comprises a timer, and the display modes of the display sections are changed corresponding to time measured by the display-mode-setting means.

7. An air hockey game apparatus as claimed in claim 6, wherein the timer constituting the display-mode-setting means measures time passing in the game, and the display sections display remaining time of the game corresponding to the time passing in the game.

8. An air hockey game apparatus as claimed in one of claims 1 to 3, further comprising goal-detecting means for detecting entry of the puck into the goals, wherein the display-mode-setting means sets the display modes according to detection signals outputted by the goal-detecting means.

9. An air hockey game apparatus as claimed in claim 8, wherein the display sections display scores.

10. An air hockey game apparatus as claimed in claim 8, wherein the display-mode-setting means determines a game status and allows the display sections to display the game status.

11. An air hockey game apparatus as claimed in claim 8, wherein the display-mode-setting means comprises a timer, and the display modes of the display sections are changed corresponding to time measured by the display-mode-setting means.

12. An air hockey game apparatus as claimed in claim 11, wherein the timer constituting the display-mode-setting means measures time passing in the game, and the display sections display remaining time of the game corresponding to the time passing in the game.

13. An air hockey game apparatus as claimed in one of claims 1 to 3, further comprising puck-detecting means for detecting movement of the puck is provided so as to oppose the puck sliding surface, and the display-mode-setting means sets the display modes of the display sections when the puck-detecting means detects movement of the puck.

14. An air hockey game apparatus as claimed in claim 13, wherein the puck-detecting means for detecting passage of the puck is provided so as to oppose one portion of the puck sliding surface, and the display-mode-setting means sets the display modes when the puck detectors detects passage of the puck.

15. An air hockey game apparatus as claimed in claim 14, wherein the puck-detecting means is made of a plurality of light-sensitive detectors under the puck sliding surface, the puck-detecting means detects the direction in which the puck passes, and the display modes are changed corresponding to the direction in which the puck passes.

16. An air hockey game apparatus as claimed in claim 13, wherein the display-mode-setting means determines a game status and allows the display sections to display the game status.

17. An air hockey game apparatus as claimed in claim 13, wherein the display-mode-setting means comprises a timer, and the display modes of the display sections are changed corresponding to time measured by the display-mode-setting means.

18. An air hockey game apparatus as claimed in claim 17, wherein the timer constituting the display-mode-setting means measures time passing in the game, and the display sections display remaining time of the game corresponding to the time passing in the game.

19. An air hockey game apparatus as claimed in claim 1, wherein the display-mode-setting means determines a game status and allows the display sections to display the game status.

20. An air hockey game apparatus as claimed in claim 19, wherein the display-mode-setting means comprises a timer, and the display modes of the display sections are changed corresponding to time measured by the display-mode-setting means.

21. An air hockey game apparatus as claimed in claim 20, wherein the timer constituting the display-mode-setting means measures time passing in the game, and the display sections display remaining time of the game corresponding to the time passing in the game.

22. An air hockey game apparatus as claimed in claim 1, wherein the display-mode-setting means comprises a timer, and the display modes of the display sections are changed corresponding to time measured by the display-mode-setting means.

23. An air hockey game apparatus as claimed in claim 22, wherein the timer constituting the display-mode-setting means measures time passing in the game, and the display sections display remaining time of the game corresponding to the time passing in the game.

* * * * *